US008617462B2

(12) United States Patent
Omura

(10) Patent No.: US 8,617,462 B2
(45) Date of Patent: Dec. 31, 2013

(54) STEEL FOR OIL WELL PIPE EXCELLENT IN SULFIDE STRESS CRACKING RESISTANCE

(75) Inventor: Tomohiko Omura, Kishiwada (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 108 days.

(21) Appl. No.: 11/902,432

(22) Filed: Sep. 21, 2007

(65) Prior Publication Data

US 2008/0017284 A1 Jan. 24, 2008

Related U.S. Application Data

(63) Continuation of application No. PCT/JP2006/304143, filed on Mar. 3, 2006.

(30) Foreign Application Priority Data

Mar. 24, 2005 (JP) ..... 2005-086995

(51) Int. Cl.
*C22C 38/22* (2006.01)
*C22C 38/60* (2006.01)
*C22C 38/00* (2006.01)

(52) U.S. Cl.
USPC ..... 420/105; 420/84; 420/106; 420/121; 148/330; 148/334

(58) Field of Classification Search
USPC ..... 148/330, 334; 420/84, 106, 121, 105
See application file for complete search history.

(56) References Cited

U.S. PATENT DOCUMENTS 5,938,865 A * 8/1999 Kondo et al. ..... 148/593

FOREIGN PATENT DOCUMENTS

| | | | |
|---|---|---|---|
| AR | 023265 | | 4/2000 |
| AR | 034070 | | 1/2004 |
| AR | 035035 | | 4/2004 |
| AR | 050079 | | 10/2008 |
| CA | 2490700 | A1 * | 12/2003 |
| EP | 0 828 007 | | 3/1998 |
| EP | 1 496 131 | | 3/2003 |
| JP | 58-161720 | | 9/1983 |
| JP | 59-232220 | | 12/1984 |
| JP | 60-086209 | | 5/1985 |
| JP | 61-272351 | | 2/1986 |
| JP | 61-272351 | | 12/1986 |
| JP | 61279656 | A * | 12/1986 |
| JP | 62-013557 | | 1/1987 |
| JP | 62-54021 | | 3/1987 |
| JP | 62-253720 | | 11/1987 |
| JP | 63093822 | A * | 4/1988 |
| JP | 5-65592 | | 3/1993 |
| JP | 6-220536 | | 8/1994 |
| JP | 6-322478 | | 11/1994 |
| JP | 7-41856 | | 2/1995 |
| JP | 8-311551 | | 11/1996 |
| JP | 9-59719 | | 3/1997 |
| JP | 9-249935 | | 9/1997 |
| JP | 11-335731 | | 12/1999 |
| JP | 2000-119798 | | 4/2000 |
| JP | 2000-178682 | | 6/2000 |
| JP | 2000-256783 | | 9/2000 |
| JP | 2000-297344 | | 10/2000 |
| JP | 2001-271134 | | 10/2001 |
| JP | 2004-2978 | | 1/2004 |
| WO | WO 00/68450 | | 11/2000 |

OTHER PUBLICATIONS

Aliya et al., Solid-State Phase Transformations-ASM Handbook, 2004, ASM International, vol. 9, p. 1-22.*
Isokawa et al., English translation of JP 61-279656A, 1986.*
Takahashi et al., English translation of JP 63-093822A, Apr. 25, 1988, whole document.*
S. Avner, "Introduction to physical metallurgy", McGraw-Hill, Inc., 1974, ISBN 0-07-002499-5, pp. 314-315.
Callister, Jr., William D., "Fundamentals of Materials Science and Engineering", an Interactive e-Text, Fifth Edition, c 2001, John Wiley & Sons, pp. 323-364.

* cited by examiner

*Primary Examiner* — Roy King
*Assistant Examiner* — Caitlin Kiechle
(74) *Attorney, Agent, or Firm* — Clark & Brody

(57) ABSTRACT

A steel for an oil well pipe, having high strength and excellent SSC resistance, consists of, by mass %, C: 0.30 to 0.60%, Si: 0.05 to 0.5%, Mn: 0.05 to 1.0%, Al: 0.005 to 0.10%, Cr+Mo: 1.5 to 3.0%, wherein Mo is 0.5% or more, V: 0.05 to 0.3%, Nb: 0 to 0.1%, Ti: 0 to 0.1%, Zr: 0 to 0.1%, N (nitrogen): 0 to 0.03%, Ca: 0 to 0.01%, and the balance Fe and impurities; P 0.025% or less, S 0.01% or less, B 0.0010% or less and O (oxygen) 0.01% or less. The method involves heating the steel at 1150° C. or more; producing a seamless steel pipe by hot working; water-cooling the pipe to a temperature in a range of 400 to 600° C. immediately after finishing the working; and subjecting the pipe to a heat treatment for bainite isothermal transformation in a range of 400 to 600° C.

2 Claims, No Drawings

STEEL FOR OIL WELL PIPE EXCELLENT IN SULFIDE STRESS CRACKING RESISTANCE

This application is a continuation of International Patent Application No. PCT/JP2006/304143, filed Mar. 3, 2006. This PCT application was not in English as published under PCT Article 21(2).

TECHNICAL FIELD

The present invention relates to a low alloy steel for oil well pipes excellent in sulfide stress cracking resistance, which is suitable for a casing and tubing for an oil well or gas well, and a method for producing a seamless steel pipe for an oil well from the steel.

BACKGROUND ART

High strength has been required for oil well pipes because recently oil wells have become deeper and deeper. That is, the oil well pipe of 110 ksi class has been recently used in many cases, instead of 80 ksi class and 95 ksi class pipes that were conventionally used widely for the oil well pipes. The 110 ksi class means a pipe having a yield stress (YS) of 110 to 125 ksi (758 to 862 MPa), while the 80 ksi class means a pipe having a YS of 80 to 95 ksi (551 to 654 MPa), and the 95 ksi class means a pipe having a YS of 95 to 110 ksi (654 to 758 MPa).

On the other hand, the oil well and gas well, which are developed nowadays, often contains corrosive hydrogen sulfide. In such environment hydrogen embrittlement, which is referred to as sulfide stress cracking, hereinafter abbreviated as SSC, is generated in the high strength steel and causes destruction. Accordingly, the most important issue for the oil well pipes of high strength is to overcome the SSC.

Techniques such as "making the steel extremely clean" and "grain refining" have been widely used as a method for improving the SSC resistance of the oil well pipe of the YS 95 to 110 ksi class (654 to 758 MPa class). For example, a method for reducing impurity elements such as Mn and P, in order to improve the SSC resistance, is disclosed in Patent Document 1. A method for improving the SSC resistance by double quenching in order to refine the crystal grain is disclosed in Patent Document 2.

Furthermore, the high strength oil well pipe such as 125 ksi class, which has not been applied for heretofore, has been examined recently. The 125 ksi class has a YS of 125 to 140 ksi, that is 862 to 965 MPa. Since the SSC is easily generated in the high strength steel, the further improvement of the material is required compared with the conventional oil well pipe of 95 to 110 ksi class (654 to 758 MPa class).

A method for providing a steel of 125 ksi class (862 MPa class) having a refined structure and excellent SSC resistance is disclosed in Patent Document 3. In this method a heat treatment, using induction heating, is applied. A method for producing a steel pipe using a direct quenching method is disclosed in Patent Document 4. The method provides the steel pipe of 110 to 140 ksi class (758 to 965 MPa class) which has excellent SSC resistance. In this method, the excellent SSC resistance can be attained by quenching from a high temperature in order to increase the martensite ratio, sufficiently dissolving alloy elements such as Nb and V during quenching, utilizing the elements for precipitation strengthening during the following tempering, and raising the tempering temperature.

An invention for optimizing alloy components in order to produce a low alloy steel having excellent SSC resistance of 110 to 140 ksi class (758 to 965 MPa class) is disclosed in Patent Document 5. Methods for controlling the form of carbide in order to improve the SSC resistance of a low alloy steel for an oil well of 110 to 140 ksi class (758 to 965 MPa class) are disclosed in Patent Document 6, Patent Document 7 and Patent Document 8. A technique for introducing precipitation of a great amount of fine V carbides in order to delay the generating time of the SSC of a steel product of 110 to 125 ksi class (758 to 862 MPa class) is disclosed in Patent Document 9.

Patent Document 1: Publication of Unexamined Patent Application Sho 62-253720.

Patent Document 2: Publication of Unexamined Patent Application Sho 59-232220.

Patent Document 3: Publication of Unexamined Patent Application Hei 6-322478

Patent Document 4: Publication of Unexamined Patent Application Hei 8-311551

Patent Document 5: Publication of Unexamined Patent Application Hei 11-335731

Patent Document 6: Publication of Unexamined Patent Application 2000-178682

Patent Document 7: Publication of Unexamined Patent Application 2000-256783

Patent Document 8: Publication of Unexamined Patent Application 2000-297344

Patent Document 9: Publication of Unexamined Patent Application 2000-119798

DISCLOSURE OF THE INVENTION

Subject to be Solved by the Invention

Various techniques for improving the SSC resistance of the high strength steel have been proposed, as described above, but it is hard to say that excellent SSC resistance is always stably secured in the oil well pipe of 125 ksi or more class by these techniques, and further improvement of the SSC resistance is required.

It is the primary objective of the present invention to provide a steel for oil well pipes having high strength and excellent SSC resistance. The second objective is to provide a method for producing a seamless steel pipe for oil wells having the above characteristics.

Means for Solving the Problem

The low alloy steel for an oil well pipe whose strength is adjusted by the heat treatment of quenching and tempering, requires tempering at a low temperature in order to obtain high strength. However, the low temperature tempering increases density of dislocation, which can be a hydrogen trap site. Further, coarse carbides are preferentially precipitates on the grain boundaries during low temperature tempering, thereby easily generating the grain boundary fracture type SSC. This means that the low temperature tempering reduces the SSC resistance of the steel.

Therefore, the present inventor focused attention on C (carbon) as an alloy element so that high strength could be maintained even when the steel is subjected to a high temperature tempering. The strength after quenching can be enhanced by increasing the content of C, and it can be expected that the tempering at a temperature which is higher than that of the conventional oil well pipe, can improve the SSC resistance. However, according to the conventional knowledge, it has been said that a great amount of carbide is generated when C is excessively contained in the steel and the SSC resistance deteriorates. Therefore, the content of C has been suppressed to 0.3% or less in the conventional low alloy steel for oil well pipes. In the steel containing an excess amount of C, the quenching crack tends to appear during water quenching. The large amount of C content has been avoided because of the above-mentioned reasons.

The present inventor has found a technique for greatly improving the SSC resistance, even when the C content is high. In the technique, the content of Cr, Mo and V are optimized and the content of B, which enhances the generation of coarse carbides on the grain boundaries, is reduced. Hereinafter, the knowledge that is a basis of the present invention will be described in detail.

(1) It is considered that the reduction of the SSC resistance, due to the increase of C content, is mainly caused by the precipitation of the coarse carbides such as $M_3C$ (cementite; M is Fe, Cr and Mo) and $M_{23}C_6$ (M is Fe, Cr and Mo) on the grain boundaries. Therefore, it is considered that the SSC resistance can be ensured by refining the carbide even when the content of C is increased. The refining can be achieved by adding V of a predetermined amount. When the V is contained, the excess amount of C precipitates as a fine carbide MC (M is V and Mo) in the steel. Since Mo is also contained as solid-solution in the MC and contributes to the forming of the fine MC, Mo of a predetermined amount or more must be also contained.

(2) The conventional oil well pipe, which contains C of less than 0.3%, contains B in order to improve the hardenability. However, B is replaced by C, and induces the formation of the coarse carbides, $M_3C$ or $M_{23}C_6$, on the grain boundaries, therefore, the B content should be reduced as much as possible. The deficiency of the hardenability due to the reduction of B can be supplemented by adding of Mo or Mo and Cr in addition to C. Therefore, it is necessary to set the total content of Cr and Mo to a predetermined amount or more. However, since an excess amount of Cr and Mo enhances the formation of the coarse carbides, $M_{23}C_6$, it is necessary to suppress the total content of Cr and Mo within the predetermined amount.

(3) As the method for producing the seamless steel pipe, the conventional "quenching and tempering" or the "direct quenching and tempering", in which the quenching is performed immediately after making the seamless steel pipe, is preferable. However, the quenching crack tends to appear in the steel, which has a high C content, during quenching, so it is preferable to quench by a method such as shower water-cooling and oil-cooling, in which the cooling rate is not excessive, in order to prevent the quenching crack. However, special equipment must be provided for the shower water-cooling or the oil-cooling, and the productivity falls in making the seamless steel pipe.

In order to completely dissolve, the carbide-forming elements such as C, Cr, Mo and V by quenching and to effectively utilize the carbide-forming elements at the time of the subsequent tempering, the quenching temperature is preferably 900° C. or higher. The quenching temperature is more preferably 920° C. or higher.

(4) For manufacturing of the seamless steel pipe having high C content at a high production efficiency, the direct quenching method is preferable. In the direct quenching process, in order to also secure a good SSC resistance, it is effective to use a "cutting the cooling process short method", in which the water-cooling is stopped at the half-way point of the direct quenching, inducing bainite transformation. In this method, after heating the steel ingot at 1150° C. or higher, the seamless steel pipe is manufactured from the ingot followed by water-cooling. The water-cooling may be performed immediately after the manufacturing the pipe, or after the recrystallizing of the structure by a complementary heating in a temperature range of 900 to 950° C. immediately after making the pipe.

(5) When the pipe is cooled to room temperature by water-cooling, martensitic transformation arises and the quenching crack appears. Therefore, the water-cooling is stopped at a temperature between 400 and 600° C., which is higher than the starting temperature of the martensitic transformation. However, a dual phase structure consisting of martensite and bainite is formed when the steel is air-cooled from the temperature at which water-cooling is stopped, and the SSC resistance deteriorates. Therefore, an isothermal transformation heat treatment, i.e., austemper treatment, should be performed in a furnace heated between 400 and 600° C. immediately after the water-cooling stops, and the dual phase structure should be transformed to the bainite single phase structure. If the strength after the isothermal transformation heat treatment is too high, the pipe may be tempered by heating it again in a temperature range of 600 to 720° C. in order to adjust the strength.

(6) In a bainite single phase structure, obtained by the method of the above item (5), carbides are finely dispersed, and the steel pipe having such a structure has the SSC resistance equivalent to that of a steel pipe having a martensite single phase structure, produced by the conventional quenching and tempering treatment. Since the pipe is directly made after heating the billet to 1150° C. or higher, the carbide-forming elements such as C, Cr, Mo and V can be fully dissolved until the starting time of the water-cooling. These elements can be fully utilized during the subsequent bainite transformation heat treatment and tempering.

The present invention has been accomplished on the basis of the above knowledge, and it relates to the following steel for an oil well pipe and the method for producing thereof.

(1) A steel for an oil well pipe, excellent in sulfide stress cracking resistance, characterized in that the steel consists of, by mass %, C: 0.30 to 0.60%, Si: 0.05 to 0.5%, Mn: 0.05 to 1.0%, Al: 0.005 to 0.10%, Cr+Mo: 1.5 to 3.0%, wherein Mo is 0.5% or more, V: 0.05 to 0.3%, Nb: 0 to 0.1%, Ti: 0 to 0.1%, Zr: 0 to 0.1%, N: 0 to 0.03%, Ca: 0 to 0.01%, and the balance Fe and impurities, and P as an impurity is 0.025% or less, S as an impurity is 0.01% or less, B as an impurity is 0.0010% or less and O (oxygen) as an impurity is 0.01% or less.

(2) A steel for an oil well pipe, excellent in sulfide stress cracking resistance according to above (1), consisting of, by mass %, C: 0.30 to 0.60%, Si: 0.05 to 0.5%, Mn: 0.05 to 1.0%, Al: 0.005 to 0.10%, Cr+Mo: 1.5 to 3.0%, wherein Mo is 0.5% or more, V: 0.05 to 0.3%, and the balance Fe and impurities, and P as an impurity is 0.025% or less, S as an impurity is 0.01% or less, B as an impurity is 0.0010% or less and O (oxygen) as an impurity is 0.01% or less.

(3) A steel for an oil well pipe, excellent in sulfide stress cracking resistance according to above (1) containing one or more selected from Nb: 0.002 to 0.1 mass %, Ti: 0.002 to 0.1 mass % and Zr: 0.002 to 0.1 mass %.

(4) A steel for an oil well pipe, excellent in sulfide stress cracking resistance according to above (1), in which the N (nitrogen) content is 0.003 to 0.03 mass %.

(5) A low alloy steel for an oil well pipe, excellent in sulfide stress cracking resistance according to above (1), in which the Ca content is 0.0003 to 0.01 mass %.

(6) A steel for an oil well pipe, excellent in sulfide stress cracking resistance according to above (1) containing one or more selected from Nb: 0.002 to 0.1 mass %, Ti: 0.002 to 0.1 mass % and Zr: 0.002 to 0.1 mass %, in which the N (nitrogen) content is 0.003 to 0.03 mass %.

(7) A steel for an oil well pipe, excellent in sulfide stress cracking resistance according to above (1), in which the N (nitrogen) content is 0.003 to 0.03 mass % and the Ca content is 0.0003 to 0.01 mass %.

(8) A steel for an oil well pipe, excellent in sulfide stress cracking resistance according to above (1) containing one or more selected from Nb: 0.002 to 0.1 mass %, Ti: 0.002 to 0.1 mass % and Zr: 0.002 to 0.1 mass %, in which the N (nitrogen) content is 0.003 to 0.03 mass % and the Ca content is 0.0003 to 0.01 mass %.

(9) A steel for an oil well pipe, excellent in sulfide stress cracking resistance according to any one of above (1) to (8), wherein the yield stress is 125 ksi (862 MPa) or more.

(10) A method for producing a seamless steel pipe for an oil well, comprising the steps of:

heating a steel ingot having a chemical composition according to any one of above (1) to (8) at 1150° C. or higher;

producing the seamless steel pipe from the ingot by hot working;

water-cooling the seamless steel pipe to a temperature in a range of 400 to 600° C. immediately after completing the hot working; and subjecting the seamless steel pipe to a heat treatment for bainite isothermal transformation by holding the seamless steel pipe at a temperature in a range of 400 to 600° C.

(11) A method for producing a seamless steel pipe for an oil well, comprising the steps of:

heating a steel ingot having the chemical composition according to any one of above (1) to (8) at 1150° C. or higher;

producing the seamless steel pipe from the ingot by hot working;

performing a complementary heating treatment in a temperature range of 900 to 950° C. after finishing the hot working;

water-cooling the seamless steel pipe to a temperature in a range of 400 to 600° C.; and subjecting the seamless steel pipe to a heat treatment for bainite isothermal transformation by holding the seamless steel pipe at a temperature in a range of 400 to 600° C.

BEST MODE FOR CARRYING OUT THE INVENTION (A) Chemical Composition of the Steel Reasons for determining the chemical composition of the steel for an oil well pipe of the present invention will be described with the effect of each component. Hereinafter, "%" for contents of the respective elements means "% by mass".

C: 0.30 to 0.60%

C is an important element in the steel of the present invention. The oil well pipe of the present invention contains C in an amount of more than that of the conventional oil well pipe material, and thereby the hardenability is effectively enhanced to improve the strength. In order to obtain the effect, the oil well pipe must contain C of 0.30% or more. On the other hand, even when the oil well pipe contains C exceeding 0.60%, the effect is saturated, therefore the upper limit is set at 0.60%. The content of C is more preferably 0.35 to 0.55%.

Si: 0.05 to 0.5%

Si is an effective element for the deoxidizing of the steel, and also has an effect for enhancing tempering-softening resistance. The oil well pipe must contain Si of 0.05% or more for the deoxidizing. On the other hand, a content exceeding 0.5% advances the formation of a soft ferrite phase and reduces the SSC resistance, therefore, the content of Si is set at 0.05 to 0.5%. The content of Si is more preferably 0.05 to 0.35%.

Mn: 0.05 to 1.0%

Mn is an effective element for ensuring the hardenability of the steel. The oil well pipe must contain Mn of 0.05% or more in order to obtain the proper effect. On the other hand, when the content of Mn exceeds 1.0%, it segregates on grain boundaries with impurity elements such as P and S, and the SSC resistance deteriorates. Therefore, the content of Mn should be 0.05 to 1.0%. The more preferable Mn content is 0.1 to 0.5%.

Al: 0.005 to 0.10%

Al is an effective element for the deoxidizing of the steel, and when the content of Al is less than 0.005%, this effect is not obtained. On the other hand, even when the oil well pipe contains Al exceeding 0.10%, the effect is saturated, and thereby the upper limit is set at 0.10%. The content of Al is more preferably 0.01 to 0.05%. The Al content of the present invention stands for the content of acid soluble Al, i.e., "sol. A".

Cr+Mo: 1.5 to 3.0%, wherein Mo is 0.5% or more

Cr and Mo are effective elements for enhancing the hardenability of the steel, and the steel of this invention must contain 1.5% or more of the total content of Cr and Mo in order to obtain this effect. On the other hand, when the total content of Cr and Mo exceeds 3.0%, the formation of the coarse carbides, $M_{23}C_6$ (M: Fe, Cr and Mo) is enhanced, and the SSC resistance is reduced. Therefore, the total content of Cr and Mo is set at 1.5 to 3.0%. The total content of Cr and Mo is more preferably 1.8 to 2.2%. Cr is an optional element, therefore, when Cr is not added, the content of Mo should be 1.5 to 3.0%.

Mo has an effect of promoting the formation of the fine carbide, MC (M: V and Mo) when it is contained with V. This fine carbide makes the tempering temperature higher, so in order to obtain the effect, the steel must have a content of Mo of 0.5% or more. The more preferable Mo content is 0.7% or more.

V: 0.05 to 0.3%

V forms the fine carbide MC (M: V and Mo) with Mo, and the fine carbide makes the tempering temperature higher. The V content should be 0.05% or more in order to obtain the proper effect. On the other hand, even when the steel contains V exceeding 0.3%, the amount of V, existing as solid-solution by quenching, is saturated, and the effect for raising the tempering temperature is also saturated. Accordingly, the upper limit is set at 0.3%, but the content of V is more preferably 0.1% to 0.25%.

The following Nb, Ti, Zr, N and Ca are optional elements that can be added if necessary. Effects and reasons for restriction of content of these elements will be described below.

Nb, Ti, Zr: 0 to 0.1% respectively

Nb, Ti and Zr are optional elements. They combine with C and N to form carbonitride, which effectively refines the crystal grain due to its pinning effect, and this improves the mechanical properties such as toughness. In order to obtain a sufficient effect, the preferable contents of Nb, Ti and Zr are 0.002% or more respectively. On the other hand, since the effect is saturated even when Nb, Ti and Zr exceed 0.1% respectively, the upper limits were set at 0.1% respectively. It is more preferable that the contents are 0.01 to 0.05% respectively.

N: 0 to 0.03%

N is also an optional element. N and C combine with Al, Nb, Ti and Zr to form carbonitride, which contributes to crystal grain refining due to the pinning effect, and improves the mechanical properties such as toughness. The preferable N content is 0.003% or more in order to definitely obtain the proper effect. On the other hand, even when the N exceeds 0.03%, the effect is saturated. Accordingly, the upper limit was set at 0.03%, but the more preferable content is 0.01 to 0.02%.

Ca: 0 to 0.01%

Ca is also an optional element. It combines with S in the steel to form sulfide, and improves the shape of inclusions. Therefore, Ca contributes to the improvement of the SSC resistance. The preferable content of Ca is 0.0003% or more in order to obtain the proper effect. On the other hand, even when the Ca content exceeds 0.01%, the effect is saturated. Accordingly, the upper limit was set at 0.01%, but the content of Ca is more preferably 0.001 to 0.003%.

The steel for oil well pipes of the present invention consists of the above-mentioned elements and the balance of Fe and impurities. However, it is necessary to control P, S, B and O (oxygen) among impurities as follows.

P: 0.025% or less

P segregates on the grain boundaries, and reduces the SSC resistance. Since the influence becomes remarkable when the content exceeds 0.025%, the upper limit is set at 0.025%. The content of P is preferably as low as possible.

S: 0.01% or less

S also segregates on the grain boundaries similar to P, and reduces the SSC resistance. Since the influence becomes remarkable when the content exceeds 0.01%, the upper limit is set at 0.01%. The content of S is also preferably as low as possible.

B: 0.0010% or less

B has been used for the conventional low alloy steel oil well pipe in order to enhance the hardenability. However, B accelerates the formation of grain boundary coarse carbides $M_{23}C_6$ (M: Fe, Cr or Mo) in high strength steel, and also reduces the SSC resistance. Therefore, B is not added in the pipe of the present invention. Even when B may be contained as an impurity, it should be limited to 0.0010% or less. It is more preferable to limit the content of B to 0.0005% or less.

O (oxygen): 0.01% or less

O (oxygen) exists in the steel as an impurity. When its content exceeds 0.01%, it forms coarse oxide, and reduces the toughness and the SSC resistance. Therefore, the upper limit is set at 0.01%. It is preferable to reduce the content of O (oxygen) as low as possible.

(B) Method for Producing Seamless Steel Pipe

In order to produce the seamless steel pipe, having a high C content and excellent SSC resistance at high productivity, it is preferable to perform the heat treatment, wherein the water-cooling is stopped on the way in direct quenching process, and to induce bainite transformation thereafter.

The heating temperature of the billet is preferably 1150° C. or higher for good productivity of the pipe. The preferable upper limit of the heating temperature is about 1300° C. in order to reduce scale formation.

After manufacturing the seamless steel pipe from the heated billet by the usual method, for example, a method such as the Mannesmann mandrel mill method, the seamless steel pipe is directly quenched by water-cooling. The direct quenching may be performed immediately after making the pipe, or after a complementary heating in a temperature range of 900 to 950° C. The complementary heating is performed immediately after the pipe manufacturing for recrystallization of the steel structure. In order to prevent quenching crack, the water-cooling should be stopped in a temperature range of 400 to 600° C., and the pipe should be held in a temperature range of 400 to 600° C. after stopping the water-cooling. An isothermal heat treatment for the bainite transformation is performed in the above-mentioned temperature range. If necessary, the tempering is performed by heating again, in a temperature range of 600 to 720° C., in order to give it the proper strength.

The reason for stopping the water-cooling in the temperature range of 400 to 600° C. is as follows. When the temperature is lower than 400° C., martensite partially appears, and a dual phase structure of the martensite and bainite is formed, which deteriorates SSC resistance. On the other hand, when the temperature is higher than 600° C., a feathery upper bainite is formed, and the SSC resistance is reduced by the formation of coarse carbides. The restriction of the soaking temperature in the range of 400 to 600° C., for the bainite isothermal transformation treatment, is based on the same reason as the above.

With reference to the complementary heating before water-cooling, the reason for setting the temperature from 900 to 950° C. is that the lower limit temperature for recrystallization to the austenite single phase structure is 900° C. and grain coarsening appears by heating at a temperature exceeding 950° C.

Example

Hereinafter, the effect of the present invention will be specifically described according to examples.

Steels of 150 ton each, having chemical compositions shown in Table 1, were melted, and blocks having a thickness of 40 mm were made. After heating these blocks at 1250° C., plates having a thickness of 15 mm were produced by hot forging and hot rolling.

(1) QT Treatment

The plates were quenched by oil-cooling after heating in a temperature range of 900 to 920° C. for 45 minutes, and then tempered by holding in a temperature range of 600 to 720° C. for 1 hour and air-cooled. The strength was adjusted to two levels of about 125 ksi (862 MPa) as the upper limit of 110 ksi class (758 MPa class), and about 140 ksi (965 MPa) as the upper limit of the 125 ksi class (862 MPa class). Hereinafter, the heat treatment is referred to as "QT treatment".

(2) AT Treatment

The steels A to V in Table 1 were made into billets having outer diameters of 225 to 310 mm. These billets were heated to 1250° C., and were worked into seamless steel pipes having various sizes by the Mannesmann mandrel method. Pipes of the steels A, C and E were water-cooled immediately after the working. Referring to the pipes made from the steels B, D and F to V, the complementary heating treatment was performed in a temperature range of 900 to 950° C. for 5 minutes, and the water-cooling was performed immediately after the complementary heating treatment. The water-cooling was stopped when the temperature of the pipe became between 400 and 600° C., and the pipes were put in a furnace adjusted to 400 to 600° C. immediately after the stopping of water-cooling. Thereafter, the pipes were subjected to the bainite isothermal transformation heat treatment, wherein the pipes were held in the furnace for 30 minutes and air-cooled. Then, the pipes were tempered by holding in a temperature range of 600 to 720° C. for 1 hour and air-cooled in order that the strengths were adjusted to two levels of about 125 ksi (862 MPa) as the upper limit of 110 ksi class (758 MPa class) and about 140 ksi (965 MPa) as the upper limit of 125 ksi class (862 MPa class). Hereinafter, the heat treatment is referred to as "AT treatment".

Round bar tensile test pieces having a parallel portion diameter of 6 mm and a parallel length of 40 mm were sampled by cutting out the plates and pipes parallel to the rolled direction. Strengths of the plates and pipes were respectively adjusted to two levels by the above-mentioned heat treatment. The tensile tests were performed at room temperature, and YS was measured. The SSC resistance was estimated by the following two kinds of tests, i.e., the constant load test and DCB test.

(1) Constant Load Test

Round bar tensile test pieces, having a parallel portion diameter of 6.35 mm and a parallel length of 25.4 mm, were sampled by cutting out the plates and pipes parallel to the rolled direction. The SSC resistances were estimated by the constant load test according to the NACE TM 0177 A method. NACE means National Association of Corrosion Engineers. The following two kinds of test solutions were used and 90% of the true YS was loaded:

(i) Solution of 5% sodium chloride and 0.5% of acetic acid at normal temperature, which is saturated with 1 atm of hydrogen sulfide gas (hereinafter referred to as A-bath)

(ii) Solution of 5% sodium chloride and 0.5% of acetic acid at normal temperature, which is saturated with 0.1 atm of hydrogen sulfide gas and the balance of carbon dioxide (hereinafter, referred to as B-bath)

In the above test, the tested materials, which were not fractured for 720 hours, were determined to have good SSC resistance, and were showed by "○" in Table 2. The "A-bath" was used for the evaluation of the steel products of about YS 125 ksi (862 MPa), and the "B-bath" was used for the evaluation of the steel products of about YS 140 ksi (965 MPa).

(2) DCB Test

DCB (Double Cantilever Bent Beam) test pieces, having a thickness of 10 mm, a width of 20 mm and a length of 100 mm, were sampled from the plates and pipes, and a DCB test was performed according to NACE TM 0177 D method. The DCB test bars were immersed in A-bath or B-bath for 336 hours, and the stress intensity factor ($K_{ISSC}$ value) was measured. The test material having the $K_{ISSC}$ value of 27 or more was determined to have good SSC resistance. The test results are shown in Table 2.

TABLE 1

| | | Chemical Composition (mass %, Fe: bal.) | | | | | | | | |
|---|---|---|---|---|---|---|---|---|---|---|
| Group | Steel | C | Si | Mn | P | S | sol. Al | Cr | Mo | Cr + Mo |
| Example of the Present Invention | A | 0.41 | 0.09 | 0.46 | 0.004 | 0.002 | ##### | — | 2.05 | 2.05 |
| | B | 0.32 | 0.32 | 0.43 | 0.003 | 0.001 | ##### | — | 1.53 | 1.53 |
| | C | 0.38 | 0.10 | 0.46 | 0.008 | 0.005 | ##### | 0.51 | 1.51 | 2.02 |
| | D | 0.55 | 0.12 | 0.44 | 0.006 | 0.004 | ##### | 0.74 | 1.05 | 1.79 |
| | E | 0.38 | 0.10 | 0.46 | 0.008 | 0.005 | ##### | 1.25 | 0.74 | 1.99 |
| | F | 0.55 | 0.12 | 0.44 | 0.006 | 0.004 | ##### | 1.01 | 0.76 | 1.77 |
| | G | 0.39 | 0.11 | 0.41 | 0.005 | 0.002 | ##### | — | 2.12 | 2.12 |
| | H | 0.45 | 0.23 | 0.41 | 0.006 | 0.005 | ##### | — | 2.06 | 2.06 |
| | I | 0.45 | 0.21 | 0.35 | 0.005 | 0.003 | ##### | — | 2.05 | 2.05 |
| | J | 0.37 | 0.09 | 0.76 | 0.005 | 0.002 | ##### | — | 1.98 | 1.98 |
| | K | 0.35 | 0.22 | 0.30 | 0.002 | 0.002 | ##### | — | 2.24 | 2.24 |
| | L | 0.39 | 0.12 | 0.76 | 0.005 | 0.001 | ##### | — | 2.08 | 2.08 |
| | M | 0.38 | 0.10 | 0.43 | 0.004 | 0.002 | ##### | — | 2.04 | 2.04 |
| | N | 0.41 | 0.13 | 0.44 | 0.006 | 0.003 | ##### | — | 2.11 | 2.11 |
| | O | 0.46 | 0.11 | 0.42 | 0.005 | 0.004 | ##### | — | 2.09 | 2.09 |
| | P | 0.36 | 0.16 | 0.44 | 0.004 | 0.002 | ##### | 1.26 | 0.73 | 1.99 |
| | Q | 0.38 | 0.18 | 0.45 | 0.005 | 0.002 | ##### | 1.08 | 0.76 | 1.84 |
| | R | 0.37 | 0.15 | 0.42 | 0.003 | 0.002 | ##### | 1.24 | 0.69 | 1.93 |
| | S | 0.38 | 0.21 | 0.45 | 0.004 | 0.003 | ##### | 1.23 | 0.71 | 1.94 |
| | T | 0.37 | 0.19 | 0.46 | 0.005 | 0.002 | ##### | 1.21 | 0.74 | 1.95 |
| | U | 0.47 | 0.13 | 0.42 | 0.007 | 0.001 | ##### | 1.24 | 0.64 | 1.88 |
| | V | 0.36 | 0.27 | 0.44 | 0.005 | 0.002 | ##### | 1.25 | 1.01 | 2.26 |
| Comparative Example | W | 0.28* | 0.33 | 0.44 | 0.007 | 0.002 | ##### | — | 2.03 | 2.03 |
| | X | 0.38 | 0.74* | 0.41 | 0.003 | 0.001 | ##### | — | 2.07 | 2.07 |
| | Y | 0.39 | 0.21 | 1.21* | 0.004 | 0.002 | ##### | 0.51 | 1.55 | 2.06 |
| | Z | 0.37 | 0.20 | 0.46 | 0.031* | 0.004 | ##### | 0.53 | 1.61 | 2.14 |
| | 1 | 0.51 | 0.12 | 0.43 | 0.005 | 0.011* | ##### | 0.73 | 1.02 | 1.75 |
| | 2 | 0.46 | 0.13 | 0.44 | 0.007 | 0.003 | ##### | 1.50 | 0.40* | 1.90 |
| | 3 | 0.42 | 0.13 | 0.43 | 0.005 | 0.003 | ##### | 0.50 | 0.70 | 1.20* |
| | 4 | 0.32 | 0.31 | 0.46 | 0.003 | 0.001 | ##### | 1.25 | 2.05 | 3.30* |
| | 5 | 0.41 | 0.11 | 0.41 | 0.005 | 0.002 | ##### | 1.23 | 2.12 | 2.12 |
| | 6 | 0.41 | 0.13 | 0.45 | 0.006 | 0.004 | ##### | — | 2.08 | 2.08 |
| | 7 | 0.40 | 0.12 | 0.40 | 0.004 | 0.003 | ##### | — | 1.99 | 1.99 |

| | | Chemical Composition (mass %, Fe: bal.) | | | | | | | |
|---|---|---|---|---|---|---|---|---|---|
| Group | Steel | V | O | Nb | Ti | Zr | N | Ca | B |
| Example of the Present Invention | A | 0.10 | ##### | — | — | — | — | — | 0.0000 |
| | B | 0.24 | ##### | — | — | — | — | — | 0.0001 |
| | C | 0.25 | ##### | — | — | — | — | — | 0.0000 |
| | D | 0.26 | ##### | — | — | — | — | — | 0.0000 |
| | E | 0.25 | ##### | — | — | — | — | — | 0.0000 |
| | F | 0.26 | ##### | — | — | — | — | — | 0.0002 |
| | G | 0.11 | ##### | 0.03 | — | — | — | — | 0.0000 |
| | H | 0.12 | ##### | — | ##### | — | — | — | 0.0001 |
| | I | 0.09 | ##### | — | — | ##### | — | — | 0.0000 |
| | J | 0.12 | ##### | — | — | — | ##### | — | 0.0000 |
| | K | 0.11 | ##### | — | — | — | — | ##### | 0.0003 |
| | L | 0.10 | ##### | 0.03 | — | — | ##### | — | 0.0000 |

TABLE 1-continued

| | | | | | | | | | |
|---|---|---|---|---|---|---|---|---|---|
| | | M | 0.11 | ##### | 0.03 | — | — | — | ##### | 0.0000 |
| | | N | 0.11 | ##### | — | — | — | ##### | ##### | 0.0001 |
| | | O | 0.12 | ##### | 0.03 | — | — | ##### | ##### | 0.0000 |
| | | P | 0.10 | ##### | 0.02 | — | — | — | — | 0.0000 |
| | | Q | 0.25 | ##### | — | ##### | — | — | — | 0.0001 |
| | | R | 0.20 | ##### | — | — | ##### | — | — | 0.0000 |
| | | S | 0.23 | ##### | 0.02 | — | — | ##### | — | 0.0001 |
| | | T | 0.24 | ##### | 0.03 | — | — | — | 0.002 | 0.0000 |
| | | U | 0.22 | ##### | — | — | — | ##### | 0.002 | 0.0000 |
| | | V | 0.20 | ##### | 0.03 | — | — | ##### | ##### | 0.0001 |
| | Comparative | W | 0.10 | ##### | 0.03 | — | — | — | — | 0.0000 |
| | Example | X | 0.11 | ##### | 0.02 | — | — | — | — | 0.0002 |
| | | Y | 0.09 | ##### | 0.03 | — | — | — | — | 0.0000 |
| | | Z | 0.11 | ##### | 0.01 | — | — | — | — | 0.0001 |
| | | 1 | 0.26 | ##### | 0.01 | — | — | — | — | 0.0000 |
| | | 2 | 0.24 | ##### | 0.02 | — | — | — | — | 0.0000 |
| | | 3 | 0.24 | ##### | 0.02 | — | — | — | — | 0.0000 |
| | | 4 | 0.26 | ##### | 0.02 | — | — | — | — | 0.0003 |
| | | 5 | 0.05* | ##### | 0.03 | — | — | — | — | 0.0000 |
| | | 6 | 0.12 | 0.0121* | 0.03 | — | — | — | — | 0.0000 |
| | | 7 | 0.11 | ##### | 0.03 | — | | — | — | 0.0011* |

Note:
"*" shows values outside of the present invention.

TABLE 2

| Group | Test No. | Steel | Heat Treatment | YS (MPa) | Constant Load Test (A-bath) | DCB Test $K_{ISSC}$ | YS (MPa) | Constant Load Test (B-bath) | DCB Test $K_{ISSC}$ |
|---|---|---|---|---|---|---|---|---|---|
| Example of the Present Invention | 1 | A | QT | 873 | ○ | 32.5 | 991 | ○ | 32.8 |
| | 2 | B | QT | 890 | ○ | 31.2 | 984 | ○ | 32.1 |
| | 3 | C | QT | 891 | ○ | 31.4 | 999 | ○ | 30.9 |
| | 4 | D | QT | 888 | ○ | 31.0 | 993 | ○ | 31.5 |
| | 5 | E | QT | 892 | ○ | 30.8 | 981 | ○ | 31.2 |
| | 6 | F | QT | 876 | ○ | 31.9 | 988 | ○ | 32.4 |
| | 7 | G | QT | 891 | ○ | 31.5 | 991 | ○ | 32.0 |
| | 8 | H | QT | 883 | ○ | 32.4 | 987 | ○ | 32.3 |
| | 9 | I | QT | 879 | ○ | 32.0 | 992 | ○ | 32.4 |
| | 10 | J | QT | 888 | ○ | 31.9 | 981 | ○ | 32.2 |
| | 11 | K | QT | 891 | ○ | 31.4 | 983 | ○ | 30.9 |
| | 12 | L | QT | 887 | ○ | 32.8 | 993 | ○ | 32.4 |
| | 13 | M | QT | 893 | ○ | 31.2 | 994 | ○ | 31.6 |
| | 14 | N | QT | 892 | ○ | 31.8 | 997 | ○ | 31.5 |
| | 15 | O | QT | 890 | ○ | 32.1 | 982 | ○ | 31.8 |
| | 16 | P | QT | 872 | ○ | 33.0 | 993 | ○ | 32.4 |
| | 17 | Q | QT | 886 | ○ | 31.8 | 989 | ○ | 32.1 |
| | 18 | R | QT | 891 | ○ | 32.1 | 994 | ○ | 31.9 |
| | 19 | S | QT | 890 | ○ | 31.9 | 986 | ○ | 32.4 |
| | 20 | T | QT | 898 | ○ | 30.7 | 997 | ○ | 31.1 |
| | 21 | U | QT | 877 | ○ | 32.7 | 993 | ○ | 31.9 |
| | 22 | V | QT | 892 | ○ | 31.4 | 995 | ○ | 31.6 |
| | 23 | A | AT | 883 | ○ | 32.1 | 988 | ○ | 31.8 |
| | 24 | B | AT | 889 | ○ | 30.8 | 986 | ○ | 31.9 |
| | 25 | C | AT | 893 | ○ | 31.2 | 997 | ○ | 32.0 |
| | 26 | D | AT | 887 | ○ | 31.6 | 995 | ○ | 32.1 |
| | 27 | E | AT | 886 | ○ | 31.2 | 986 | ○ | 32.3 |
| | 28 | F | AT | 879 | ○ | 30.9 | 984 | ○ | 31.9 |
| | 29 | G | AT | 890 | ○ | 32.0 | 989 | ○ | 32.1 |
| | 30 | H | AT | 886 | ○ | 32.1 | 991 | ○ | 31.9 |
| | 31 | I | AT | 881 | ○ | 32.3 | 987 | ○ | 32.3 |
| | 32 | J | AT | 885 | ○ | 32.1 | 992 | ○ | 32.0 |
| | 33 | K | AT | 889 | ○ | 31.9 | 984 | ○ | 31.8 |
| | 34 | L | AT | 891 | ○ | 31.5 | 987 | ○ | 31.4 |
| | 35 | M | AT | 895 | ○ | 31.9 | 991 | ○ | 32.2 |
| | 36 | N | AT | 890 | ○ | 31.6 | 995 | ○ | 32.1 |
| | 37 | O | AT | 888 | ○ | 31.4 | 993 | ○ | 31.9 |
| | 38 | P | AT | 892 | ○ | 32.1 | 990 | ○ | 32.0 |
| | 39 | Q | AT | 891 | ○ | 32.5 | 989 | ○ | 31.4 |
| | 40 | R | AT | 893 | ○ | 31.9 | 991 | ○ | 31.0 |
| | 41 | S | AT | 887 | ○ | 32.1 | 987 | ○ | 32.8 |
| | 42 | T | AT | 885 | ○ | 31.5 | 989 | ○ | 32.5 |
| | 43 | U | AT | 886 | ○ | 31.9 | 993 | ○ | 31.5 |
| | 44 | V | AT | 887 | ○ | 31.7 | 991 | ○ | 32.0 |
| Comparative Example | 45 | W | QT | 862 | x | 25.1 | 968 | x | 24.6 |
| | 46 | X | QT | 863 | x | 26.2 | 966 | x | 26.4 |
| | 47 | Y | QT | 864 | x | 25.8 | 975 | x | 26.2 |
| | 48 | Z | QT | 871 | x | 26.4 | 968 | x | 25.9 |

TABLE 2-continued

| Group | Test No. | Steel | Heat Treatment | YS (MPa) | Constant Load Test (A-bath) | DCB Test $K_{ISSC}$ | YS (MPa) | Constant Load Test (B-bath) | DCB Test $K_{ISSC}$ |
|---|---|---|---|---|---|---|---|---|---|
| | 49 | 1 | QT | 864 | x | 25.8 | 969 | x | 25.4 |
| | 50 | 2 | QT | 864 | x | 26.3 | 971 | x | 25.8 |
| | 51 | 3 | QT | 871 | x | 24.8 | 968 | x | 25.1 |
| | 52 | 4 | QT | 869 | x | 26.8 | 973 | x | 25.9 |
| | 53 | 5 | QT | 874 | x | 24.5 | 971 | x | 26.1 |
| | 54 | 6 | QT | 868 | x | 27.8 | 966 | x | 26.8 |
| | 55 | 7 | QT | 865 | x | 26.1 | 961 | x | 23.4 |

As described above, QT in the column of "Heat Treatment" in Table 2 shows a condition where oil quenching and tempering were performed using the plate material, and AT shows a condition where the direct quenching, the water-cooling stopping and the bainite isothermal transformation heat treatment were performed on the seamless steel pipe.

The SSC was not seen in the constant load test in the evaluation in any environment of the "A-bath" and "B-bath" in test numbers 1 to 44 where the QT treatment and AT treatment were performed using the steels A to V. The $K_{ISSC}$ values measured by the DCB test were respectively 27 or more, and the SSC resistances were good.

On the other hand, in the steel W having low C content, the steel X having high Si content, the steel Y having high Mn content, the steel Z having high P content, the steel No. 1 having high S content, the steel No. 2 having low Mo content, the steel No. 3 having low total content of Cr and Mo, the steel No. 4 having high total content of Cr and Mo, the steel No. 5 having low V content, the steel No. 6 having high O (oxygen) content, and the steel No. 7 having high B content in comparative examples, all had poor SSC resistances.

INDUSTRIAL APPLICABILITY

According to the present invention, the steel for oil well pipes having good SSC resistance together with the high strength such as the yield stress YS of 125 ksi (862 MPa) or more can be obtained. This steel is extremely useful for the material of the steel pipe for an oil well or the like to be used in a field containing hydrogen sulfide. According to the producing method of the present invention, the seamless steel pipe for an oil well having the above characteristics can be produced very efficiently.

The invention claimed is:

1. A steel for an oil well pipe that has a yield strength of 758 MPa or more and less than 862 MPa, excellent in sulfide stress cracking resistance estimated as not fractured for 720 hours by the constant load test, loaded by 90% of the true yield strength, according to the NACE TM 0177 A method, which adopts a test solution of 5% sodium chloride and 0.5% of acetic acid at normal temperature, saturated with 1 atm of hydrogen sulfide gas, wherein the steel has a bainite single phase structure and a chemical composition consisting, by mass %, of C: 0.35 to 0.60%, Si: 0.05 to 0.5%, Mn: 0.05 to 0.76%, Al: 0.005 to 0.10%, Cr+Mo: 1.5 to 3.0%, Mo is 0.5% or more, V: 0.05 to 0.3%, Nb: 0 to 0.1%, Ti: 0 to 0.1%, Zr: 0 to 0.1%, N: 0 to 0.03%, Ca: 0 to 0.01%, and the balance Fe and impurities, and P as an impurity is 0.025% or less, S as an impurity is 0.01% or less, B as an impurity is 0.0010% or less and O (oxygen) as an impurity is 0.01% or less.

2. A steel for an oil well pipe that has a yield strength of 862 MPa or more, excellent in sulfide stress cracking resistance estimated as not fractured for 720 hours by the constant load test, loaded by 90% of the true yield strength, according to the NACE TM 0177 A method, which adopts a test solution of 5% sodium chloride and 0.5% of acetic acid at normal temperature, saturated with 0.1 atm of hydrogen sulfide gas and the balance being carbon dioxide, wherein the steel has a bainite single phase structure and a chemical composition consisting, by mass %, of C: 0.35 to 0.60%, Si: 0.05 to 0.5%, Mn: 0.05 to 0.76%, Al: 0.005 to 0.10%, Cr+Mo: 1.5 to 3.0%, Mo is 0.5% or more, V: 0.05 to 0.3%, Nb: 0 to 0.1%, Ti: 0 to 0.1, Zr: 0 to 0.1, N: 0 to 0.03%, Ca: 0 to 0.01%, and the balance Fe and impurities, and P as an impurity is 0.025% or less, S as an impurity is 0.01% or less, B as an impurity is 0.0010% or less and O (oxygen) as an impurity is 0.01% or less.

* * * * *